US006610240B2

(12) United States Patent
Lee et al.

(10) Patent No.: US 6,610,240 B2
(45) Date of Patent: Aug. 26, 2003

(54) METHOD OF INJECTION MOLDING JOINTED LINKAGE SUPPORT

(75) Inventors: James S. W. Lee, Long Island, NY (US); Chiu-Keung Kwan, Kowloon (HK)

(73) Assignee: C.J. Associates, Ltd., Kowloon (HK)

( * ) Notice: Subject to any disclaimer, the term of this patent is extended or adjusted under 35 U.S.C. 154(b) by 0 days.

(21) Appl. No.: 09/992,170

(22) Filed: Nov. 6, 2001

(65) Prior Publication Data

US 2002/0055322 A1 May 9, 2002

Related U.S. Application Data

(62) Division of application No. 09/657,020, filed on Sep. 7, 2000, now Pat. No. 6,537,130.

(51) Int. Cl.[7] ..... B29C 45/44

(52) U.S. Cl. ..... 264/318; 249/145; 264/334; 425/DIG. 58

(58) Field of Search ..... 264/318, 336, 264/230; 425/DIG. 58, 577; 249/145, 64

(56) References Cited

U.S. PATENT DOCUMENTS

| | | | | | |
|---|---|---|---|---|---|
| 2,583,441 | A | * | 1/1952 | Palmer | 425/354 |
| 3,064,310 | A | * | 11/1962 | Cooprider | 264/313 |
| 4,090,687 | A | * | 5/1978 | Langhammer et al. | 249/60 |
| 4,113,829 | A | * | 9/1978 | Bowker et al. | 264/295 |
| 5,151,152 | A | * | 9/1992 | Kaeufe et al. | 216/53 |
| 5,846,473 | A | * | 12/1998 | Sorensen et al. | 264/318 |
| 5,958,321 | A | * | 9/1999 | Schoelling et al. | 264/318 |

* cited by examiner

*Primary Examiner*—Jill L. Heitbrink
(74) *Attorney, Agent, or Firm*—Michael Best & Friedrich LLC

(57) ABSTRACT

A method of injection molding a part having two undercut regions using a two-part mold. A combined pin-in-a-sleeve extends into the cavity in each of the mold parts in order to form a bore in a part to be molded in that cavity. Each pin provides a portion shaped to form an undercut region in the bore. The pins abut each other. After an injection molded part is made, the mold opens a limited and discrete distance to allow the molded part to be released from the hold of the mold cavity. Then, the mold opens fully for the continuation of a multi-step operation to pull the pins out of the undercut regions.

3 Claims, 10 Drawing Sheets

METHOD OF INJECTION MOLDING JOINTED LINKAGE SUPPORT

This application is a division of application Ser. No. 09/657,020, filed Sep. 7, 2000, now U.S. Pat. No. 6,537,130.

FIELD OF THE INVENTION

This invention relates to a jointed support system and methods to construct the same. More particularly, this invention relates to molding processes and methods of constructing many different types of support systems and structures at a relatively low cost and from a number of discrete components.

BACKGROUND AND SUMMARY OF THE INVENTION

For convenience of description, the invention will hereinafter be described, by way of example, in terms of a skeleton for a doll, a figure or toy. However, it should be understood that the invention applies equally well to many different types of devices. Some of these devices may be used for leisure or recreational devices such as toys, play jewelry, or the like. Another use of the invention might be industrial, as, for example, making a hollow spout for a gas can. Other of these devices may be utilitarian, such as a chain, stand, or the like.

An object of the invention is to provide a method of constructing structures from molded plastic parts which are produced at a reasonable cost from the fewest number of different part designs. For example, a chain might be made from only two types of discrete parts which can be snapped together. These same two types of parts may be used to make the skeleton of a toy.

Another object of the invention is to provide a method which enables a reduced cost for assembly by minimizing the required hand assembly. Here, an assembly machine should have general utility to assemble different types of parts into any of many different configurations.

Yet another object of the invention is to provide devices having a wide ranging freedom of movement in order to make jointed, movable structures. For example, a doll or toy should be able to move its body and limbs with a degree of freedom which is approximately the same degree of freedom enjoyed by the animal represented by the doll or toy.

A further object of the invention is to provide a jointed structure which may be easily moved to a particular position or posture, where it will remain without unwanted movement until it is deliberately moved again.

In keeping with an aspect of the invention, a preferred embodiment has just two basic types of parts. First, there is a rod having a ball on each end to create a shape similar to the shape of a dumbbell. A second discrete part is a sleeve in the form of a cylinder having a central bore with an undercut region near each end of the bore to form a socket. One ball of the dumbbell shaped part is pressed into the bore of a sleeve where the ball is captured in the undercut region in order to form a ball and socket joint. A series of these two types of ball and socket parts can be joined to make a linkage of any suitable length.

If the sleeve is to be manufactured at a reasonable cost and with a reasonable lifetime, the injection molded plastic part must be ejected from the mold without loss of its memory in the undercut area despite the fact that the still hot plastic part is pushed out of the mold. Over the lifetime of the sleeve, it should retain its plastic memory so that the joint retains both its freedom of movement and the degree of friction in the joint that preserves the posture of the joint until it is next moved deliberately. These features are accomplished by using a plastic which has a better memory and an appropriate flexibility characteristic so that it enables the sleeve to be ejected from the mold after the in-mold cooling and retains its memory afterward. The mold for making the sleeve opens in two steps, a first of which steps enables the plastic to cool somewhat inside the mold cavity before a pin is pulled from the undercut region as the mold opens completely in its second step.

BRIEF DESCRIPTION OF THE DRAWINGS

A preferred embodiment of the invention will become more apparent from the following specification taken with the attached drawings, in which.

DETAILED DESCRIPTION OF THE INVENTION

Figure 1:
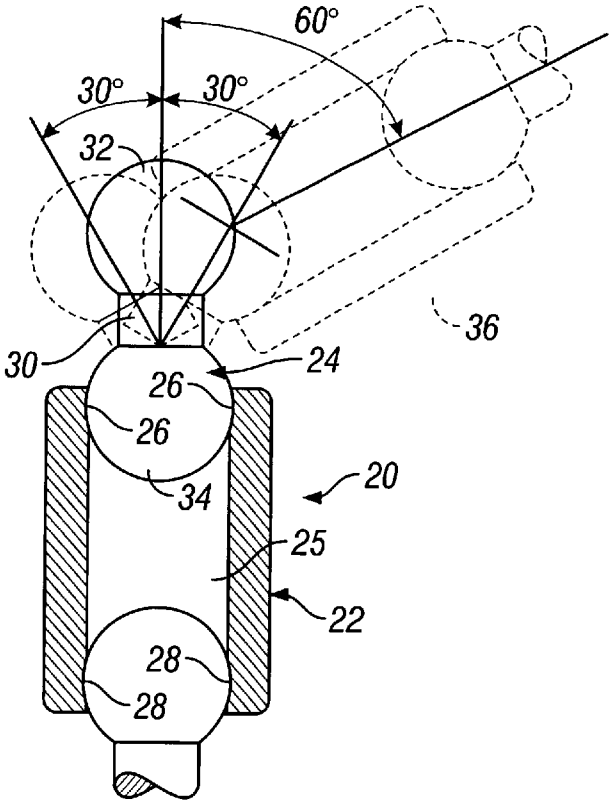
FIG. 1 shows a ball and socket joint in partial cross-section made according to the inventive method.

FIG. 1 is a plan view partly in cross-section showing a ball and socket (sleeve) in solid lines and illustrating the range of motion between the ball and the socket in dot-dashed lines. The angles of movement are within a conical region with an apex angle of 60° centered on the ball in the socket. In particular, the sleeve has an undercut region and a tight-fit feature is required for the socket in order to create enough friction to hold the ball in a position to which it is moved. When used as an internal support for a plush or stuffed toy, the resulting rigidity of the linkage inside the soft stuffing material, plush fabric, vinyl skin, and the like gives the toy the feel of real bones in the skeleton.

In greater detail, an embodiment of FIG. 1 illustrates the inventive ball and socket joint 20 which uses two discrete parts 22, 24.Part 22 is a sleeve with a central bore 25 having therein undercut regions 26, 28 near each of its two ends. Part 24 has a shape 10 somewhat like the shape of a dumbbell, i.e., a central rod 30 with balls 32, 34 on each end. The diameter of the balls is such that they may be pushed into bore 25 and captured in either of the undercut regions 26 or 28 with a grip that creates enough friction to hold the ball in place and yet allows it to be moved, if desired.

A second sleeve 36 may be snapped over the ball 32 on the other end of rod 30. Hence, a person may deliberately move part 24 relative to parts 22 and 36. However, the parts will hold their relative posture until they are next deliberately moved due to the friction between the surface of each of the balls and the surface of the respective undercut regions. Dot-dashed lines are used in FIG. 1 to illustrate the range of movement between the parts 22, 24, and 36. Each of the balls permits a center line of the parts to form any convenient angle up to 60°, for example.

Figure 15:
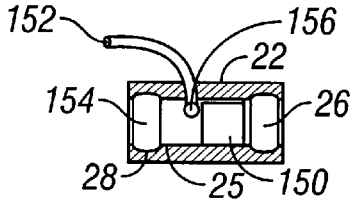
FIG. 15 is a cross section of the sleeve of FIG. 14 with the annular contact mounted within the sleeve.

Turning now to FIGS. 14–18 an alternate ball and socket joint is disclosed in accordance with an alternate embodiment of the invention. This embodiment provides an electrical switch within the joint. The switch is configures so that movement of the components forming the joint actuate the switch. Sleeve 22 is formed substantially the same as shown in FIG. 1. However, an annular contact ring 150 is fitted within the bore 25 of sleeve 22. The contact ring 150 is made from a conductive material such as copper. An electrical lead preferably formed of insulated wire is soldered to contact ring 150 at solder joint 154. The electrical lead 156 is threaded through a small exit bore 156 to communicate with external circuitry. FIG. 15 shows a cross section of sleeve 22 having the contact ring 150 mounted therein. The contact ring 150 is positioned within bore 25 adjacent the undercut region 26.

Figure 16:
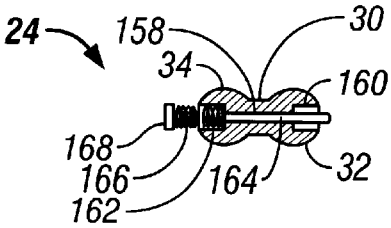
FIG. 16 is a cross section of a cooperating second part of a joint switch.

FIG. 16 shows a modified second part 24 comprising a portion of the electrical switch. As with the previous embodiment, the modified second part 24 includes a central rod portion 30 with balls 32, 34 formed at each end. In the switch embodiment a bore 158 is formed axially through the length of the modified second part. Counter-sunk bores 160, 162 are formed at each end. A conductive shaft 164 is inserted through the axial bore 158 and extends at least into the counter sunk regions 160, 162. A spring 166 is friction fit over a first end of conductive shaft 158 within counter sunk region 162 and extends out beyond the end of modified second part 24. A contact head 168 is mounted at the distal end of spring 166. At the opposite end of the shaft 164 an electrical lead 172 is soldered to the shaft.

The first and second parts 22, 24 may be joined as described above with regard to FIG. 1 to form ball and socket joint 20. Ball 34 is inserted into undercut region 26 of sleeve 22, allowing for angular motion of the second part 24 relative to the sleeve 22 in substantially every direction. A second sleeve 36 may be joined to the opposite end of the second piece 24 by inserting ball 32 into an undercut region formed within the second sleeve 36 similar to the under cut regions 26, 28 formed in sleeve 22. This arrangement is shown in cross section in FIGS. 17 and 18.

When ball 32 is inserted within a second sleeve 36, electrical lead 170 may be threaded through a small exit bore 172 formed in the side wall of second sleeve 36 to communicate with external electrical circuitry. At the opposite end of second part 24, ball 34 is movably secured within the undercut region 26 at the end of sleeve 22. Spring 166 extends from the end of second part 24 such that contact element 168, mounted at the distal end of spring 166, is positioned within the annular confines of contact ring 150. Contact ring 150 and contact element 168 form the contact elements of an electrical switch across leads 152, 170.

Figure 17:
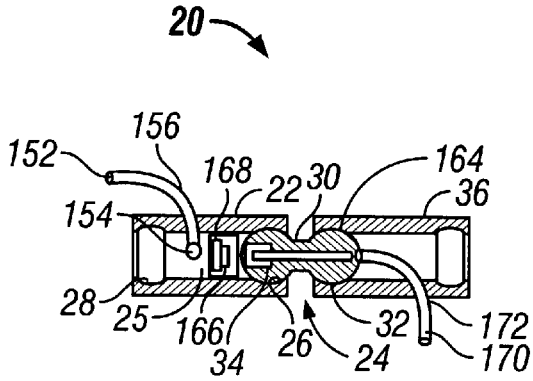
FIG. 17 is a cross section of an assembled joint switch shown in an orientation when the switch is open.
Figure 18:
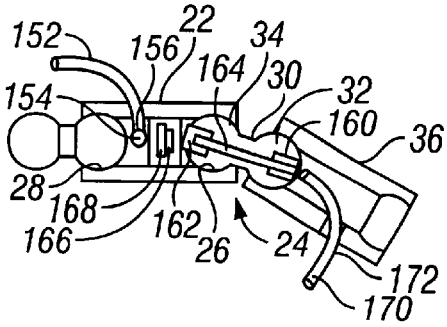
FIG. 18 is a cross section of an assembled joint switch shown in an orientation when the switch is closed.

FIG. 17 shows the sleeve 22 and second part 24 oriented in a substantially axially aligned position. As can be seen, contact element 168 is spaced apart from contact ring 150. In this position the electrical switch is open. When the second part 24 is angularly displaced relative to the sleeve 22 as shown in FIG. 18, however, the contact element 168 is pivoted against the contact ring 150, thereby closing a circuit across leads 152, 170. Due to the flexibility of spring 166, contact element 168 may be held in engagement with contact ring 150 over a wide range of displacement angles of second part 24 relative to sleeve 22, while simultaneously allowing substantially unrestricted movement of the second part 24 relative to the sleeve 22. According to an embodiment of the invention the switch joint allows movement of the second part 24 of up to 30° from the axis in any direction.

When the joint switch just described is incorporated into the skeletal frame of a toy figure, an electrical signal which is passed when the switch closes may be used to activate a special feature or special effect. For example, the switch can be used to activate a speech function, or activate various sensors such as touch sensors, sound sensors, light sensors and others.

Figure 2:
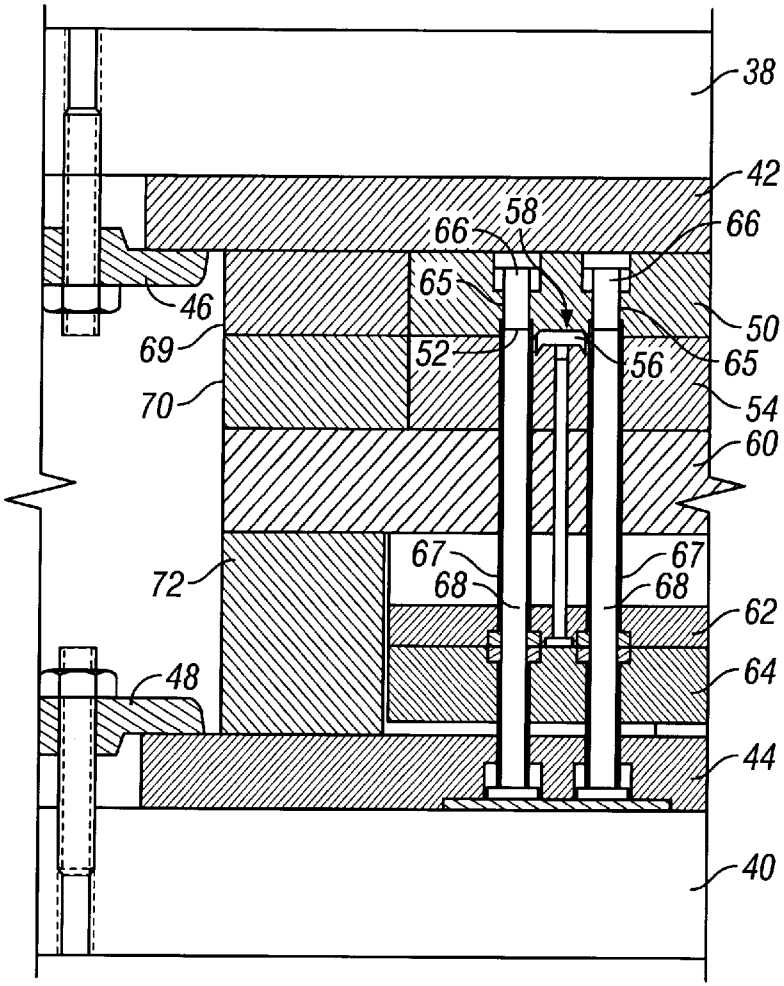
FIG. 2 shows in cross-section a closed injection mold for making the socket shown in FIG. 1.

FIG. 2 is a cross-section elevation view illustrating an inventive, specially designed two-part injection mold for making the sleeve with an undercut socket on each end. The ejection core pins provide a delay when there is an ejection of the injection molded sleeves in order to solve the mold release problem resulting from the undercut region molded into the sleeve at both ends of the socket. In FIG. 2, the two parts 50, 54 of the mold are shown in a closed position with the two mold cavities above and below the parting line for forming a single combined cavity for the injection molded sleeves such as 22, 36 (FIG. 1) when the combined cavity is filled with molten plastic resin.

Hence, FIG. 2 shows a closed mold in the process of molding a part with an undercut region. More particularly, the injection molding machine (FIG. 2) has two platens 38, 40 which move toward or away from each other in order to close or open the mold in a two-step process. Here platen 38 is fixed and platen 40 moves. Next there are top and bottom clamping plates 42, 44. These two plates 42, 44 are secured to their respective platens by hold-down clamps 46, 48. Similar clamps (not shown) are present at the opposite ends of plates 42, 44.

Plate 50 is a first cavity plate which has a first cavity for making an upper part of the injection molded sleeve 22. Plate 54 is a second cavity plate having a second cavity for making the remainder of the sleeve 22. When combined, these two cavities provide a single cavity having the complete contours of sleeve 22. The gate 58 provides for injecting molten plastic into cavities at 52 and 56. Plate 60 is a support plate. Plate 62 is an ejector retainer plate and plate 64 is an ejector plate. The ejector plate 64 contains two sleeves 67 in which lower core pins 68 slide, thereby forming two pin-in-a-sleeve combinations. Two upper core pins 66 slide in sleeves 65 located in the cavity plate 50, also forming two pin-in-a-sleeve combinations. The pins 66, 68 are aligned to form bore 25 (FIG. 1) of the sleeve 22. Each of the pins 66, 68 has an enlarged annular ring adjacent its end to form the under cut regions 26, 28 in bore 25 of the sleeve 22. Blocks 69, 70, 72 are spacers.

The injection mold shown in FIG. 2 can mold two sleeves simultaneously, the molten plastic being fed in via gate 58.

Figure 3A:
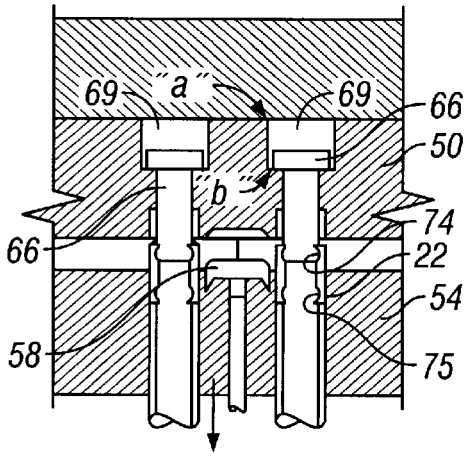
FIGS. 3A and 3B show the first two steps which partially open the mold and allow the pin to be pulled out from its undercut regions.

FIG. 3A is similar to FIG. 2, except that it shows mold plates 50, 54 partially opened in step 1 in the process for ejecting the sleeve having an undercut region in the bore. In greater detail, the mold is partly opened as the lower mold part 54 begins to move downward (FIG. 3A) in the first step of the mold opening for ejecting the molded sleeve 22. Two holes 69 allow a limited travel of pins 66 relative to movement of mold plates 50, 54 as they open to a partially open position. Due to the mold opening force on the molded sleeves 22, the upper core pins 66 will travel downwardly as they are pulled by the molded sleeves 22 (FIG. 3A) from point "a" to point "b". In this first step of the mold opening, the upper core pin 66 remains attached to the molded piece part 22 as the pin 66 moves downward because of a gripping force exerted by annular ridge 74 adjacent the end of core pin 66, ridge 74 being trapped in the undercut socket 26 within bore 25. That is, sleeve 22 initially grips pin 66 to pull the pin downward as the lower mold part 54 moves downward in the initial opening of the mold.

The travel excursion of pin 66 is limited by the depth of the hole 69 between points "a" and "b". This travel provides a delay action which allows the injection molded sleeve 22 to leave the upper mold cavity and free itself from the hold of the upper mold cavity before the later mold release feature occurs as the sleeve will be stretched and enlarged when the annular ring of the core pin goes through the sleeve undercut region.

Figure 3B:
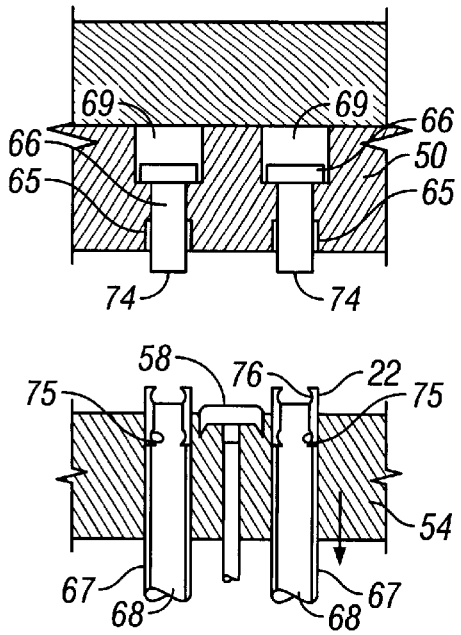

FIG. 3B shows a second step in the ejection process. The annular ridge 75 formed on the lower pin 68 is trapped in the undercut socket 28 of sleeve 22 to exert a gripping force on the sleeve 22 as the mold continues to open. Thus, as the mold opens further with lower mold part 54 continuing its downward movement, the molded sleeve 22 is pulled further downward by pin 68 off of upper pin 66. The sleeve 22 is pulled off of pin 66 when the pin reaches point "b" in hole 69 and the downward travel of pin 66 is thus stopped. During this step, the undercut region 76 of the socket 22 is enlarged enough to pass over and let go of the annular ridge 74 at lower the end of upper core pin 66. The injection part (sleeve) 22 now stays in the cavity in the other (lower) mold plate 50.

Figure 4A:
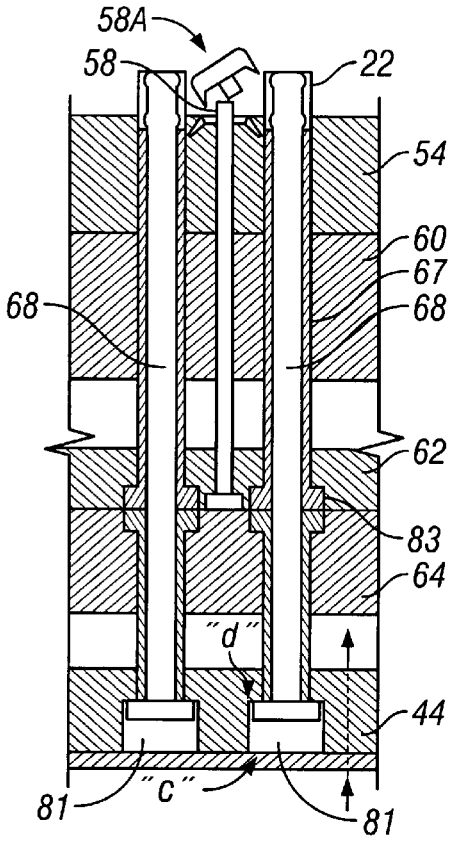
FIGS. 4A and 4B show the next two steps of knocking the injection molded sleeves out of the mold and pulling pins from the undercut regions.

After completing its downward movement, the ejector plate 64 begins to move upwardly as shown in FIG. 4A during the third step in the subject release process for injection molded parts with an undercut region. More particularly, holes 81 permit lower pin 68 to move a discrete distance as the ejector plate 64 moves upwardly. The lower core pin 68 moves from point "c" to point "d" which stops further pin travel. The injection molded sleeve part 22 thus leaves the lower half of the mold cavity, but stays on the lower core pin 68 owing to the undercut grip on the annular part 75 of pin 68, as pin 68 travels upwardly in its travel from point "c" to point "d" in hole 81. In step 4 (FIG. 4B), the ejector plate 64 continues to move upwardly so that portion 83 of ejector sleeve 67 moves the ejector sleeve 67 upwardly with respect to core pin 68. The ejector sleeve 67 is disposed around core pin 68. As a result of the action shown in FIG. 4B, the sleeve 67 pushes the injection molded part 22 off the end of core pin 68 and finally ejects it out of the mold cavity.

Figure 4B:
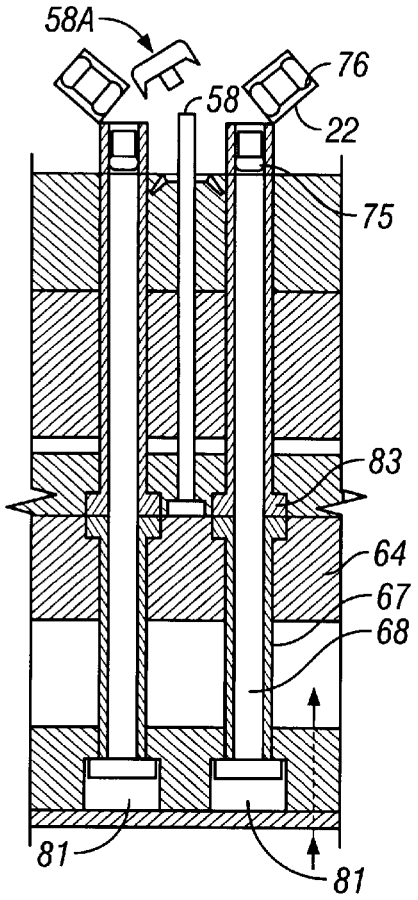

An important feature growing out of the delay action as the core pins 66, 68 and ejection sleeve 67 travel, during the steps between FIGS. 3 and 4, is that it lets the injection molded part 22 leave the mold cavity without destroying the undercut region of the sleeve 22 because the part is held on the core pins 66, 68. That is, the core pins 66, 68 hold the molded part 22 for later release as it leaves the mold cavity in order to free itself from the hold of the mold cavity. The delay allows the injection molded part to be enlarged for releasing of the annular ridge 74 on the upper core pins 66 and the annular ridge 75 on the lower core pins 68 as they move through the undercut regions 26, 28 in the sleeve 22 without destroying the undercut region of the sleeve 22. As can be seen in FIGS. 4A and 4B, the residual plastic 58 A formed at the gate 58 is discarded during the sleeve ejection.

Acetal copolymer (polyoxymethylene) is the most preferred plastic resin for producing the sleeve 22 with its undercut sockets. This material has a good memory and flexibility characteristic suitable for use by the inventive method of mold release because, by the time that the sleeve 22 is pulled off the core pins 66, 68, the undercut region can stretch over the annular enlargement of the annular rings 74, 75 of the core pins without a loss of the plastic memory. The good memory and flexibility characteristic of the preferred plastic material are also desired for use as a socket in the ball and socket joint so that it can hold the ball firmly and provide reasonable friction for preventing random movement.

The preferred plastic material for making the "sleeve/socket" is, as follows:

Plastic resin name: Acetal Copolymer/Polyoxymethylene

Brand Name/Trademark: Celcon™

Supplier: Polyplastics Co., Ltd.

Address: Kasumigaseki Bldg., 6th/Fl. 2-5 Kasumigaseki 3-chome Chiyoda-ku Tokyo, 100-6006 JAPAN The manufacturer describes the specifications of this material as:

| Property | ASTM Test Method | Units | Co-polymer |
|---|---|---|---|
| Specific Gravity | D-792 | — | 1.41 |
| Melt Flow Index | D-1238 | g/10 min | 9.0 |
| Tensile Strength, Yield | D-638 | kg./cm$^2$ | 607 |
| Tensile Elongation | D-638 | % | 60 |
| Flexural Modulus | D-790 | kg/cm$^2$ | 25,880 |
| Izod Impact Strength | D-256 | kg cm/cm | 6.9 |
| Heat Deflection Temp | D-648 | ° C. | 110 |
| Vicat Softening Point | D-1225 | ° C. | 162 |
| Water Absorption | D-570 | % | 0.22 |
| Volume Resistivity | D-257 | Ω cm | $10^{14}$ |
| Surface Resistivity | D-257 | Ω | $1.3 \times 10^{16}$ |
| Arc Resistivity | D-495 | Sec | 240 |
| Rockwell Hardness | D-785 | — | M80 |
| FDA Compliance | — | — | YES |
| Flammability | UL-94 | — | 94 HB |

Figures 5A, 5B:
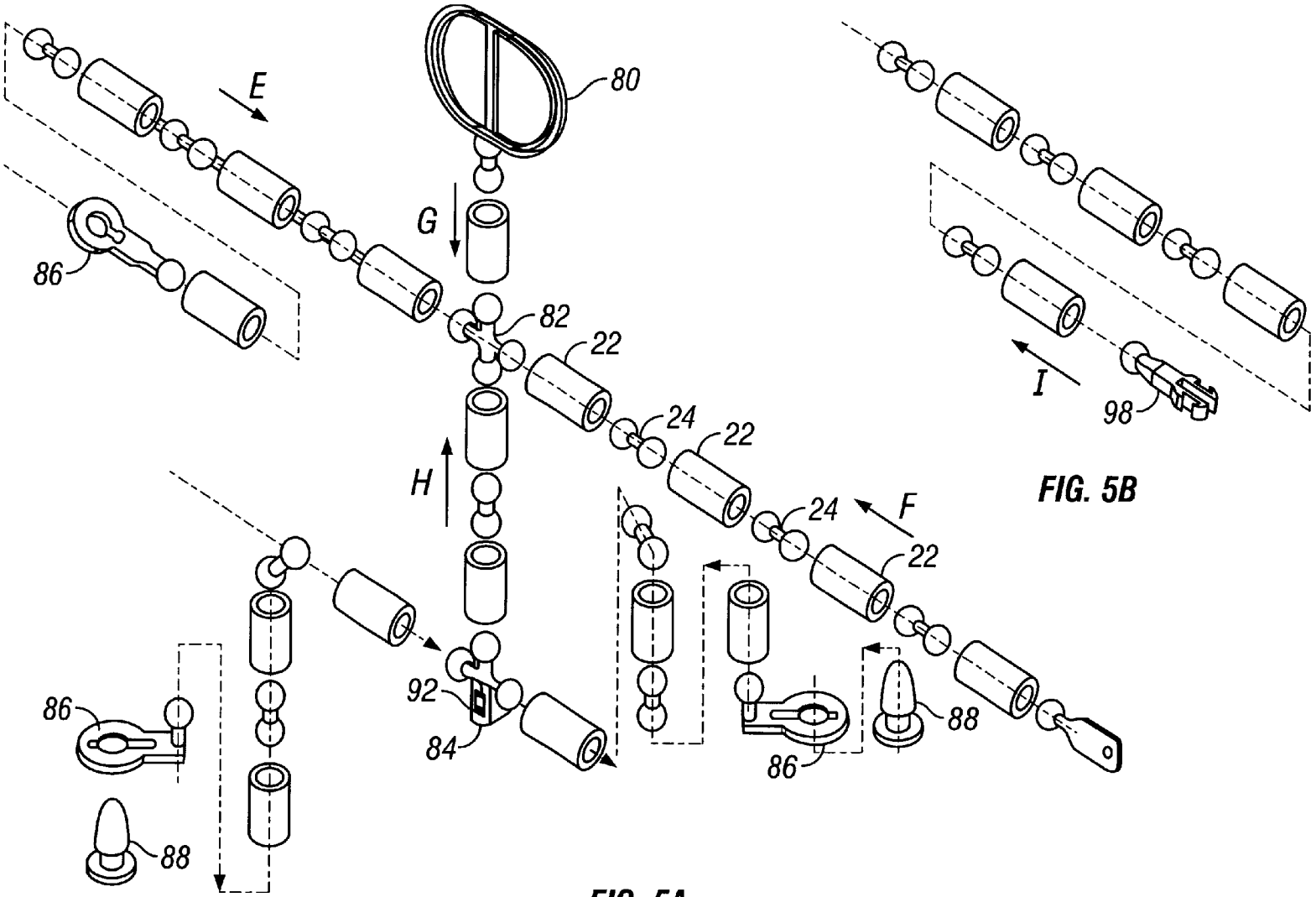
FIG. 5A illustrates how a plurality of ball and socket joints are laid out preliminary to assembly of a structure.
FIG. 5B shows a layout similar to that of FIG. 5A in order to make a simple skeleton structure (here a tail assembly)

FIGS. 5A and 5B are perspective views showing different injection molded joint parts, laid out and ready for final assembling. In greater detail, FIG. 5A shows a number of socket 22 and ball 24 joints laid out in the positions which they will occupy in the final skeleton of a plush doll, for example. In addition, FIG. 5A shows a head support part 80, a shoulder simulation part 82, and a base of spine part 84. Part 84 optionally allows an addition of a tail when the skeleton is used as part of a stuffed animal. If the skeleton is used as part of a human doll, for example, part 84 remains as shown in FIG. 5A without any tail attachment.

Parts 86 are couplers which snap over mating couplers 88 in order to secure the remainder of the toy to the skeleton. For example, couplers 88 may be secured to the interior of a stuffed animal body.

FIG. 5B is intended to show that any suitable part may be made by the inventive method. As shown here, the part is a tail for the skeleton of FIG. 5A; however, it could also be part of a child necklace, or any other suitable device. In this particular disclosure, part 90 is a coupler which slips into a window 92 of the part 84 at the base of the spine.

FIGS. 5A and 5 B include a series of arrows E-l which indicate directions in which the loose parts of FIG. 5 are to be pushed in order to assemble them into the final form of FIG. 7. For example, if the loose parts are simultaneously pushed in directions E, F, the arms and shoulder parts are joined. If the loose parts are simultaneously pushed in directions G and H, the head and spine parts are joined.

Figure 6:
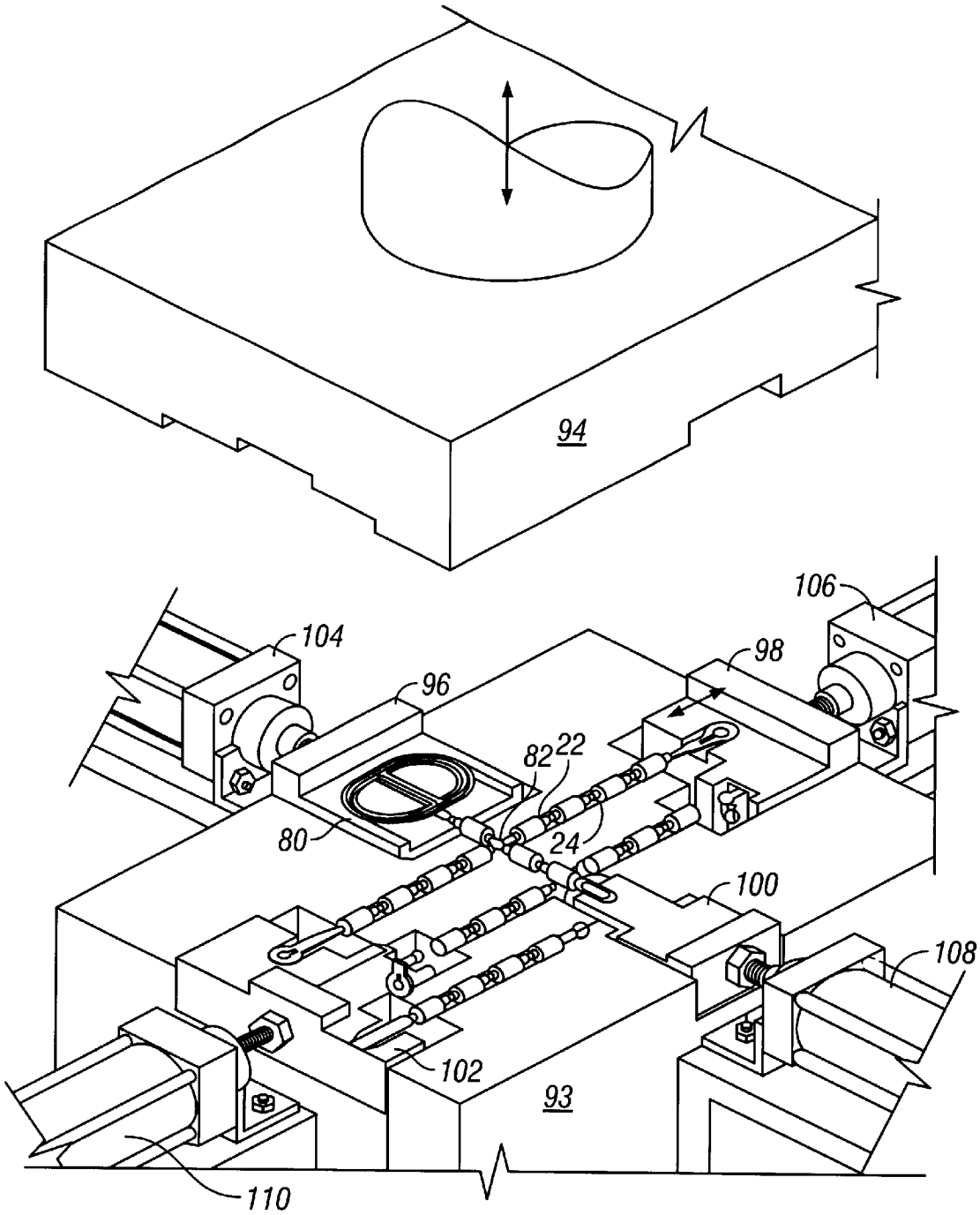
FIG. 6 shows the layout of the parts in a plate for automatically making a chain-like jointed support system by a two-step assembly process.

FIG. 6 is a perspective view which shows an automatic assembly machine for joining the loose joint parts by placing them in a fixture which is operated by a pneumatic system. The fixture has a bottom part 93, a top part 94 and four slide pieces 96–102 operated by individually associated pneumatic cylinders 104–110 mounted around the fixture bottom part 94. In greater detail, the top and bottom parts 93, 94 are simple, preferably metal, parts having grooves formed therein which follow the lines of a desired end product, such as the skeleton of FIG. 7A.

FIG. 6 shows the loose parts of FIGS. 5A and 5B laid out in the grooves in bottom plate 93. The top plate 94 has complementary grooves which enclose the loose parts after plate 94 closes over plate 93.

First, after the two plates 93, 94 close, pneumatic cylinders 104, 108 push blocks 96, 100 inwardly (Motion 1 ) which assembles the head and spine parts by pushing them together as described above in connection with FIG. 5A. Next, pneumatic cylinders 106, 110 push blocks 98, 102 inwardly (Motion 2 ) which similarly pushes the parts of the arms and tail together.

Briefly in review, all joint parts are placed in cavities formed by grooves in the fixture bottom part. By using pneumatic power, the fixture top part moves down and makes contact with the fixture bottom part, applying a suitable force in the process. All joint parts are loosely kept in place inside the cavities formed in the top and bottom parts, with a limited space tolerance for enabling further operations.

The pneumatic cylinders 104, 108 simultaneously push (Motion 1) the head part and the part at the end of the back bone with appropriate force in order to snap and interconnect all the joint parts. Then, the pneumatic cylinders 104, 108 return to their original starting positions. Next, the same actions take place as pneumatic cylinders 106, 108 push from opposite sides of the bottom part in order to interconnect the arms, legs and tail joint parts (Motion 2), and then return to their original starting positions. Thereafter, the fixture top part 94 moves up and provides space for removing the assembled skeleton.

This fixture is not limited to skeletons, but may be used for interconnecting any of many different types of loose joint parts in order to avoid excessive labor costs. Hence, this automatic assembly machine is not limited to assembling parts having the same configurations. Different cavity designs may be formed in different fixture top parts and fixture bottom parts to enable an assembly of many different configurations of linkage, at a very low cost as compared to the cost of a molding cavity.

Figure 7A:
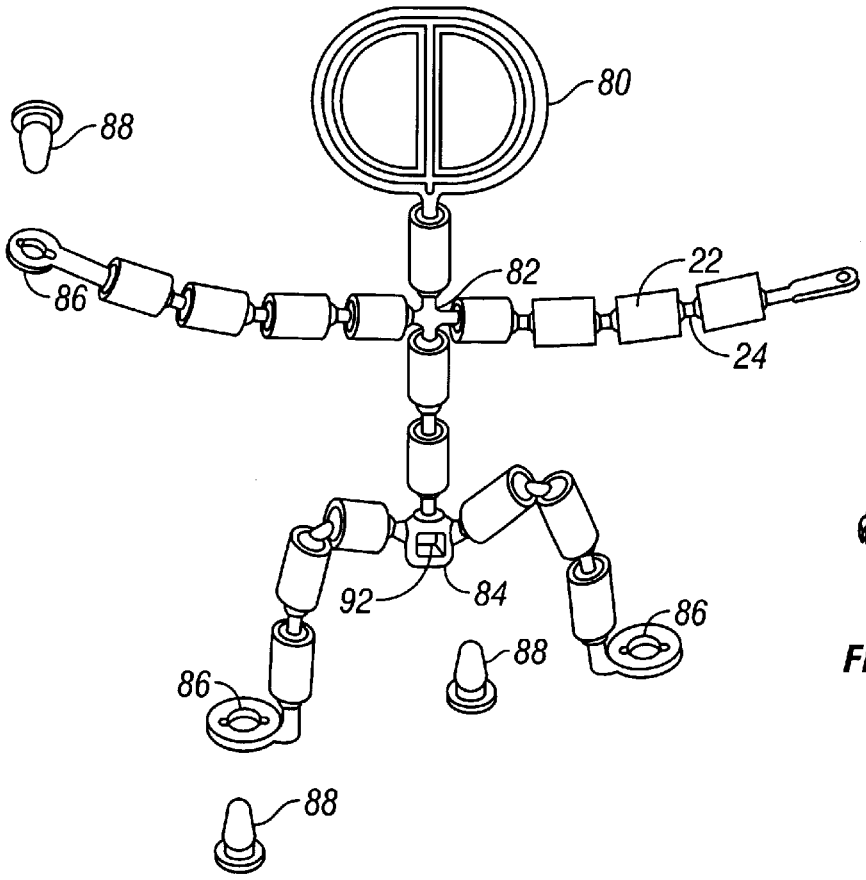
FIGS. 7A and 7B are perspective views showing an assembled jointed support system according to the present invention.
Figure 7B:
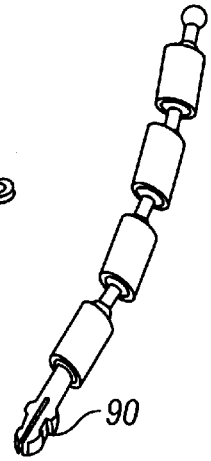

When the top fixture part 94 is lifted off the bottom fixture part 93, the jointed support systems of FIGS. 7A and 7B are removed already assembled from the grooves in bottom fixture part 93.

Figure 9:
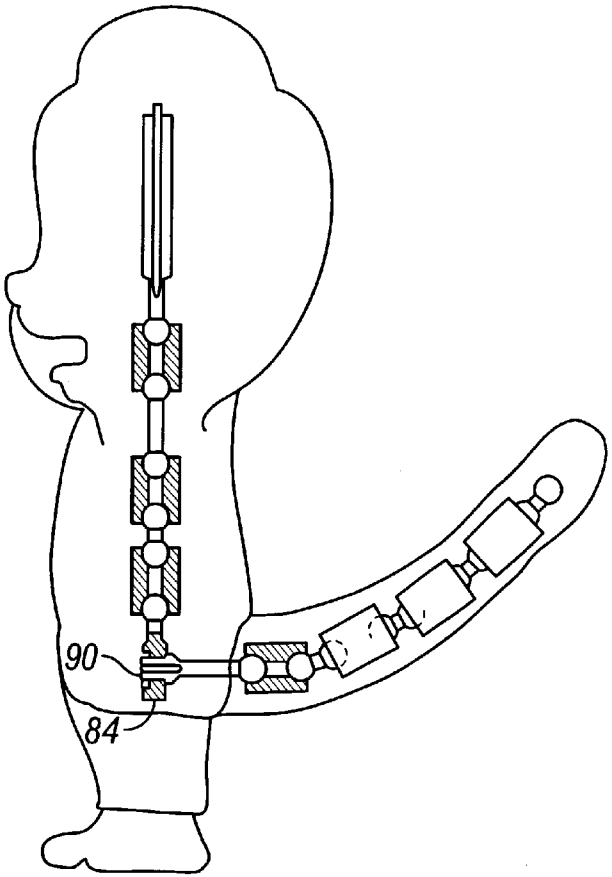
FIG. 9 is a side view which shows the doll of FIG. 8.
Figure 8:
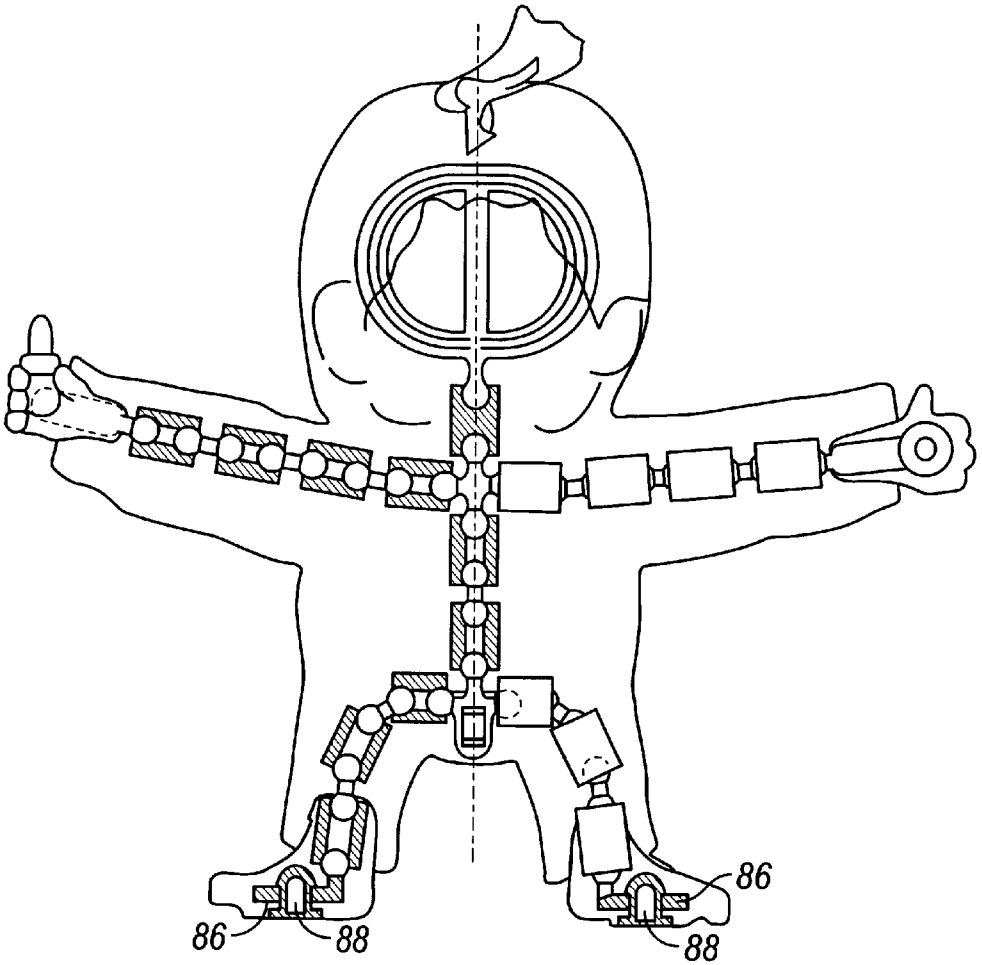
FIG. 8 is a front view which shows the structure of FIG. 7 being used as a skeleton to support a plush doll.

FIG. 8 is a front elevation view showing a stuffed plush/vinyl doll or toy supported by a skeleton comprising the molded jointed linkage support system. FIG. 9 is a side elevation view of a skeleton inside a stuffed plush/vinyl animal body with a tail attached thereto. Snap couplers 86, 88 anchor the skeleton to the inside of the stuffed toy.

Figure 10:
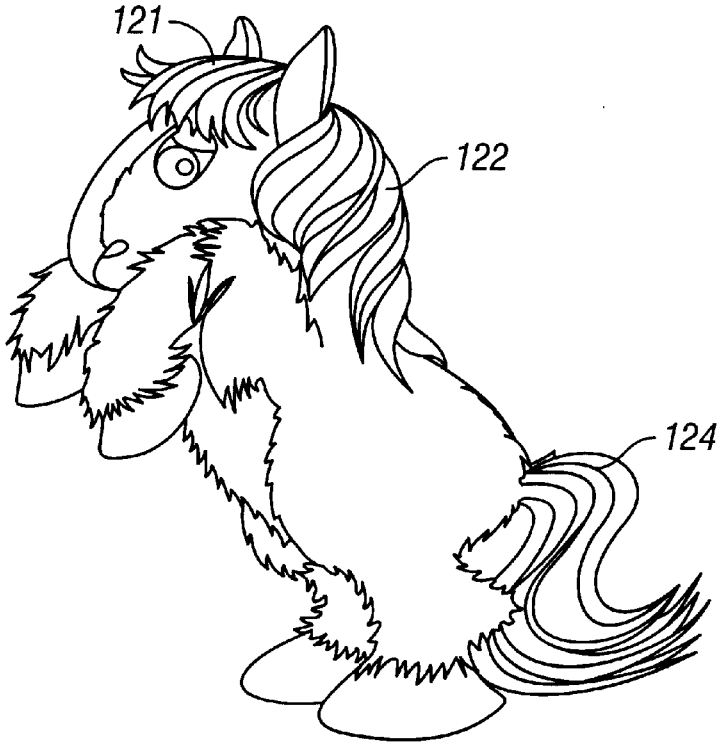
FIG. 10 is a perspective view of a rearing toy horse incorporating the jointed support system of the present invention in combination with other features.
Figure 11:
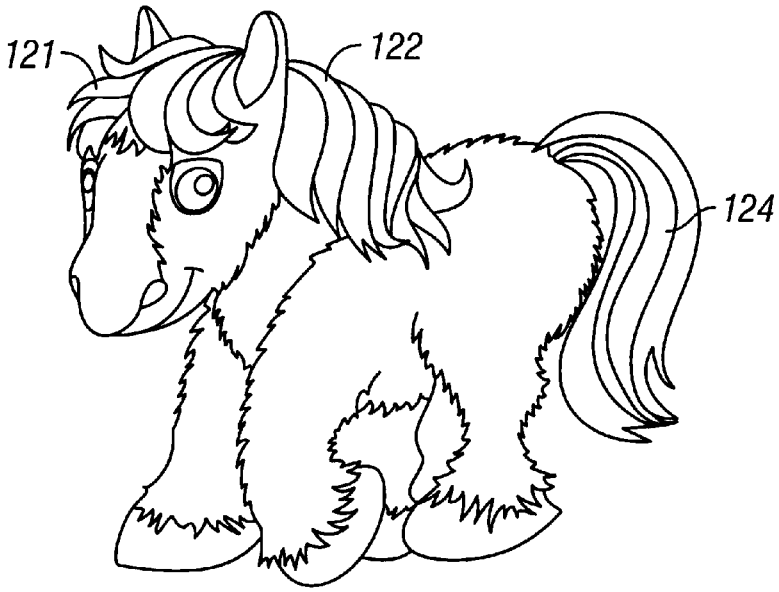
FIG. 11 is the horse of FIG. 10 adjusted to place the horse in a walking posture.

The principles of the invention may be used to make almost any suitable kind of toy or doll that can be imagined. By way of example, FIGS. 10 and 11 show a toy horse with a plush body and with a shaggy mane 122 and tail 124 which light when brushed. In FIG. 10, the skeleton has been manipulated so that the horse is in a rearing posture. In FIG. 11, the skeleton has been manipulated so that the horse is walking.

Figure 12:
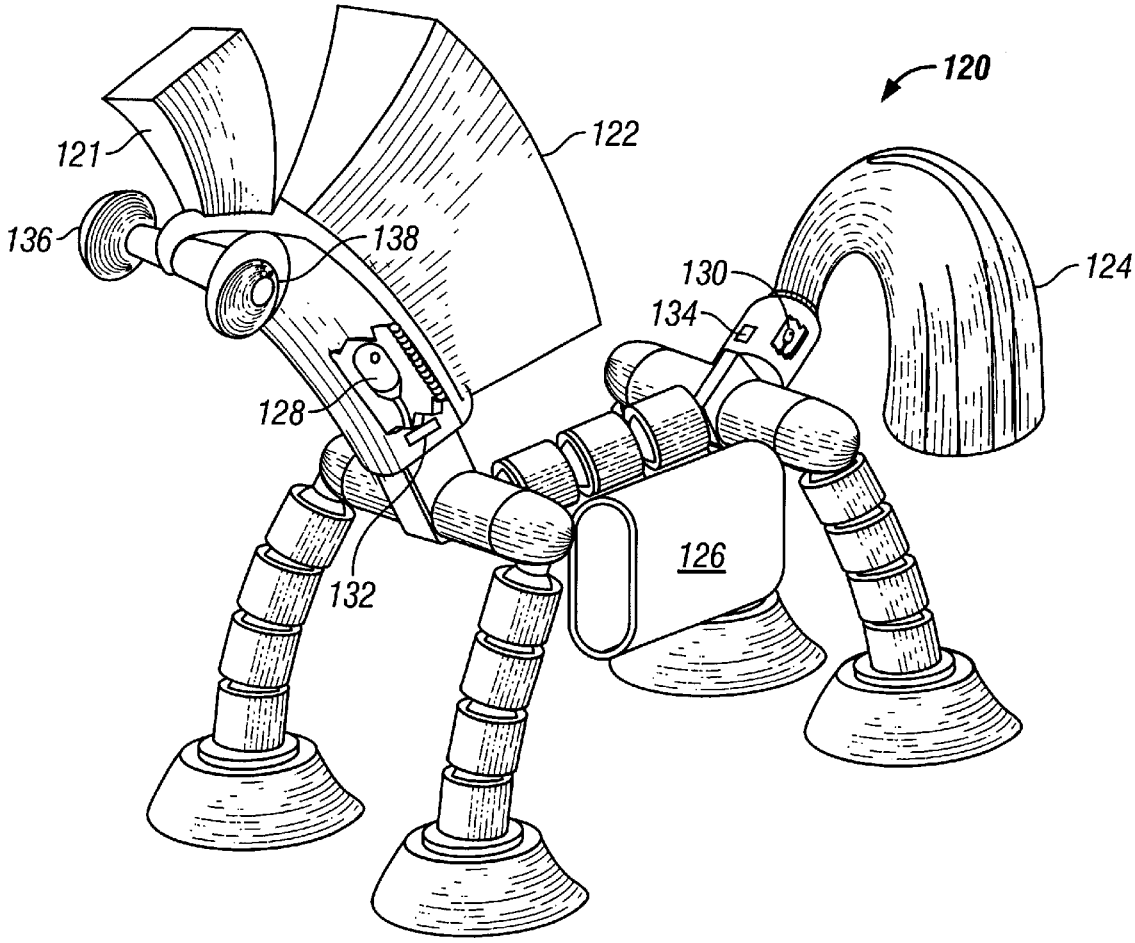
FIG. 12 is a perspective view showing the jointed support system of the present invention inside the horse of FIGS. 10 and 11.

FIG. 12 shows the skeleton 120 of the horse without the plush body. The forelock 121, mane 122, and tail 124 are optical fiber strands. A battery box 126 is adapted to receive two AA battery cells. A pair of lamp bulbs 128, 130 are positioned to light the optical fiber strands in the forelock, mane and tail, respectively. Each of these lamp bulbs is coupled to the batteries in box 126 via a pair of magnetically operated switches 132, 134, respectively.

The flexibly mounted eyes 136, 138 have a magnetic material associated therewith so that they will animate when a magnet is brought near them.

Figure 13:
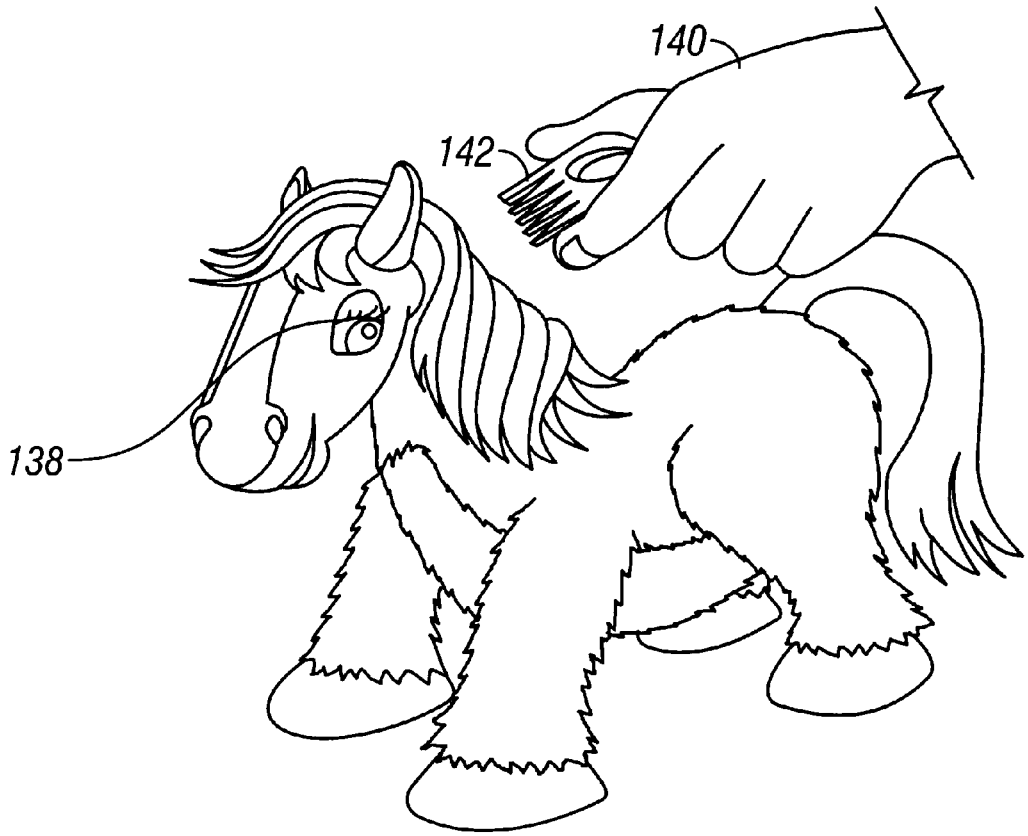
FIG. 13 shows a child's hand playing with the horse.
Figure 14:
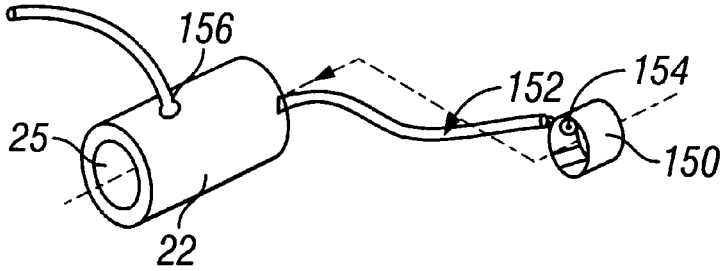
FIG. 14 is a perspective view of a sleeve and an annular contact element according to an embodiment of the invention comprising a joint switch.

FIG. 13 illustrates the operation of the toy of FIGS. 10–12. The hand 140 is holding a magnetic brush 142 which is brushing the horse mane, thereby operating magnetic switch 132 and causing bulb 128 to light the optical fiber strands so that the mane glows. Also, the eye 138 moves and appears to be watching the motion of the brush 142. In a similar manner, the tail will glow when the magnetic brush 142 is brought near switch 134.

Those who are skilled in the art will readily perceive modifications which fall within the scope and spirit of the invention. Therefore, the appended claims are to be construed to cover all equivalent structures.

The claimed invention is:

1. A method of injection molding a part having an undercut region, said method comprising the steps of:

(a) providing a two-part mold, a first part of said mold having a first portion of a single cavity and a second part of said mold having a second portion of said single cavity whereby said first and second portions form said single cavity when the mold is closed;

(b) providing a first pin in one of said mold parts, said pin extending into said cavity portion in said one mold part in order to form a portion of a bore in said molded part in said cavity, said pin having a portion shaped to form a first undercut region in said bore;

(c) providing a second pin in the other of said two mold parts, said second pin extending into said cavity portion in said other mold part in order to form another portion of said bore in said molded part, said second pin having a portion shaped to form a second undercut region in said bore, said two pins being aligned to form a single bore in said molded part, and each of said pins abutting the other of said pins between the first undercut region and the second undercut region when the mold is closed;

(d) closing said mold and injecting molten material into said single cavity;

(e) providing a sequence of operations of said pins responsive to an opening of said mold:

(i) a first of said operations causing said molded part to be ejected from the portion of said cavity in the first mold part while being held by said first and second pins;

(ii) a second of said operations allowing said molded part to release said molded part from said first pin;

(iii) a third of said operations causing said molded part to be ejected from the portion of said cavity in the second mold part while being held by said second pin; and (iv) a fourth of said operations allowing said molded part to release said molded part from said second pin.

2. The method of claim 1 wherein said second of said operations causes said molded part to be released from said first pin.

3. The method of claim 1 wherein said material is polyoxymethylene.

* * * * *